US008069678B1

(12) United States Patent
Bernert

(10) Patent No.: US 8,069,678 B1
(45) Date of Patent: Dec. 6, 2011

(54) HEAT TRANSFER IN THE LIQUEFIED GAS REGASIFICATION PROCESS

(76) Inventor: Robert E. Bernert, South Dartmouth, MA (US)

( * ) Notice: Subject to any disclaimer, the term of this patent is extended or adjusted under 35 U.S.C. 154(b) by 1160 days.

(21) Appl. No.: 11/810,172

(22) Filed: Jun. 5, 2007

Related U.S. Application Data

(60) Provisional application No. 60/811,486, filed on Jun. 7, 2006.

(51) Int. Cl.
*F17C 9/02* (2006.01)

(52) U.S. Cl. ..... 62/50.2

(58) Field of Classification Search ..... None
See application file for complete search history.

(56) References Cited

U.S. PATENT DOCUMENTS

| | | | | | |
|---|---|---|---|---|---|
| 1,672,617 | A | | 6/1928 | Lasker | |
| 3,267,692 | A | * | 8/1966 | Pfeiffer et al. | 62/515 |
| 3,735,465 | A | * | 5/1973 | Tibbetts et al. | 29/726 |
| 4,083,707 | A | | 4/1978 | Bivins | |
| 4,093,024 | A | * | 6/1978 | Middleton | 165/170 |
| 4,296,539 | A | | 10/1981 | Asami | |
| 4,399,660 | A | * | 8/1983 | Vogler et al. | 62/50.2 |
| 4,479,359 | A | * | 10/1984 | Pelloux-Gervais | 62/50.2 |
| 4,487,256 | A | * | 12/1984 | Lutjens et al. | 165/76 |
| 4,566,284 | A | | 1/1986 | Werley | |
| 4,598,554 | A | | 7/1986 | Bastian | |
| 5,251,452 | A | * | 10/1993 | Wieder | 62/50.2 |
| 5,341,769 | A | * | 8/1994 | Ueno et al. | 122/367.3 |
| 5,390,500 | A | * | 2/1995 | White et al. | 62/50.2 |
| 5,400,598 | A | | 3/1995 | Yamani | |
| 5,473,905 | A | * | 12/1995 | Billman | 62/50.2 |
| 6,082,439 | A | * | 7/2000 | Kato et al. | 165/79 |
| 6,089,022 | A | | 7/2000 | Zednik | |
| 6,481,492 | B1 | * | 11/2002 | Zhu et al. | 165/109.1 |
| 6,644,041 | B1 | | 11/2003 | Eyermann | |
| 6,664,432 | B2 | | 12/2003 | Ackerman | |
| 6,715,304 | B1 | * | 4/2004 | Wycoff | 62/155 |
| 7,475,553 | B2 | | 1/2009 | Brown | |
| 7,493,772 | B1 | | 2/2009 | Brown | |
| 2007/0022760 | A1 | | 2/2007 | Billman | |

OTHER PUBLICATIONS

Bernert The Limiting Volume Required For Cryogenic Ambient Air Vaporizers Due to Frost Formation AICHE Spring Meeting May 2000 Atlanta Paper 58e pp. 188-196.

Thermax Product Datasheet 3.1, at least Aug. 6, 2007.

* cited by examiner

*Primary Examiner* — Frantz Jules
*Assistant Examiner* — Lukas Baldridge
(74) *Attorney, Agent, or Firm* — Robert J Doherty

(57) ABSTRACT

A system and apparatus for regasifying liquefied natural gas (LNG) and other cryogenic liquids on a continuous basis utilizing improved atmospheric air vaporizer heat exchangers of the vertical single pass and parallel connected type. A multiplicity of such heat exchangers is positioned on a defined grid, such as to improve the natural convection of the ambient air heat source. An improved heat exchange system includes heat exchange elements within the heat exchangers comprised of hybrid externally finned elements, smooth interior stainless steel tubes thermally bonded within the externally finned elements, the tubes containing vortex generators. Flow distributors in the form of venturi shaped injectors are positioned at the inlet of each tube of the multiplicity of heat exchangers of the system.

8 Claims, 8 Drawing Sheets

HEAT TRANSFER IN THE LIQUEFIED GAS REGASIFICATION PROCESS

CROSS-REFERENCE TO RELATED APPLICATIONS

This application claims the benefit of U.S. Provisional Patent Application Ser. No. 60/811,486, filed Jun. 7, 2006.

FIELD OF INVENTION

This invention relates generally to the regasification of cryogenic liquefied gases and high pressure liquefied natural gas (LNG) in ambient air cryogenic vaporizers of the all parallel, externally finned vertical element type, and in an aspect relates to a continuous regasification heat transfer process in an array of multiple switching banks of natural convection ambient air heat exchanger vaporizers.

BACKGROUND OF THE INVENTION

The process of regasification of cryogenic liquefied gases and liquefied natural gas (LNG) is a well-known commercially practical process. Indeed there are several different commercial methods for carrying out the process, each process using a different source of heat for regasification. These are generally ambient air vaporizers, seawater (open rack) vaporizers, and water bath vaporizers using submerged combustion or immersed fire tube heaters.

The disadvantage of the method using the combustion of fuel as the heat source is the cost of the fuel required, the complexity of the process and the environmental consequence of the combustion itself. The seawater heat source type has the disadvantage of limited availability, an adverse effect on marine life and the corrosive effect of seawater on the materials used in the process.

In the case of ambient air vaporizers, the air as the heat source is readily available, environmentally and economically favorable and non-corrosive to the materials used. The disadvantages of using ambient air as the heat source for LNG regasifiers and cryogenic vaporizers in general are that the heat exchangers are relatively large and are limited by the temperature of and the humidity within the atmospheric air at any particular location. These problems have been partially solved by the implementation of various configurations of ambient air vaporizer heat exchangers and how individual heat exchange elements are made.

In the case of ambient air vaporizers, ambient air is the regasification heat source, which the present invention is concerned, the cryogenic liquefied gas is passed through a vaporizer comprised of an array of externally finned vertical heat exchanger tubes to heat, vaporize and superheat the cryogenic liquefied gas.

The atmospheric vaporizer in U.S. Pat. No. 4,399,660 to Vogler et. al., 1983 Apr. 23, shows a multi-pass up-down configuration defined by a critical pass heat exchange element spacing ratio. While Vogler claims continuous operation for his device, the data presented covers only a six (6) day period (Col 6, lines 14-17) of operation. Subsequent use of this configuration has shown that beyond the 6 day period performance continuously declines due to continuous ice build-up. The atmospheric heat exchange element in U.S. Pat. No. 5,350,500 to White et. al., 1995 Feb. 21 attempts to mitigate ice build up as described in Vogler. Vogler fails to instruct on the potential benefit of additional external fins beyond eight (8) possibly due to his focus on long-term ice build-up (col. 7, line 1 and col. 7 lines 18-19). White discusses switching vaporizer heat exchanger banks (col. 2, lines 27-37) to achieve continuous operation, yet he fails to fully explore conditions whereby switching may offer improvement over non-switching atmospheric vaporizers by moderating the heat transfer process for which he instructs.

The single pass ambient vaporizer in U.S. Pat. No. 5,251,451 to Weider 1993 Oct. 12 offers the improvement of counter-current flow of the air to the flow of cryogenic fluid, a well-known heat exchanger design condition. As with parallel tube heat exchangers and more particularly with boiling fluid and cryogenic vaporizers, flow maldistribution within the multiplicity of parallel flow tubular passages is compounded by the two-phase flow region as described in U.S. Pat. No. 4,083,707 to Bivins 1978 Apr. 11. This condition is dealt with by Weider by inserting a solid rod within the fluted interior of the vaporizer heat exchange element described. Weider restricts the application to an internal fluted geometry wherein the ratio of the exterior surface area to the internal, fluted, surface area is within the range of 5:1 to 25:1 (col 4, lines 23-29), restricts the use of this art to lower pressure cryogenic fluids for reasons not described and does not instruct that in stainless steel lined externally finned elements the area ratio as he defines may be in the range of 50:1 to 125:1. In U.S. Pat. No. 5,473,905 to Billman 1995 Dec. 12, a modified rod insert of a type described by Weider, for the purpose of surge control (col. 2, line 38) and the limitation of these type inserts to lower pressure cryogenic fluids is described. For higher pressure and higher pressure drops, Billman points out "twisted tape turbulators" are not always beneficial (col. 2, lines 27-33) but he apparently fails to realize that the vortex or swirl flow created by such inserts provide improvement in heat transfer at lower pressure drop for boiling or vaporizing fluids at any pressure. Billman combines different lengths of solid and hollow tube inserts in combination which require an internal fluted tube geometry with restricted internal geometries for both cross sectional fluid flow area and internal to external perimeters (surface area ratios). Billman fails to instruct on alternate means of controlling flow maldistribution, which do not require the increase of pressure drop as do the solid rod inserts he teaches for this purpose. Billman further instructs that for his invention "no significant heat transfer" (col. 4, lines 18-20) and "minimal heat transfer" (col. 4, lines 45-49) takes place at specific locations, which, minimal heat transfer however reduces heat exchanger efficiency.

As natural convection ambient air vaporization systems have become larger to meet the commercial need of higher regasification flow rates prior art has shown little appreciation for the need to be concerned that the air is the heat source for the vaporization/regasification process and that the free flow of air to an exposed ice surface is critical. Vogler as cited above instructs a ground clearance of 2 to 4 feet (col. 2, lines 57-58) and is primarily concerned with ice buildup (col. 1, lines 37-40). In U.S. Pat. No. 4,566,284 to Werley 1986 Jun. 28, is discussed improved positioning of flow passages in a vertical all series cross flow atmospheric vaporizer. This art would not apply to the vertical, parallel pass, counter flow vaporizer of this invention and does not allow full benefit of the chimney effect created by tall vertically installed all parallel heat exchanger elements.

In U.S. Pat. No. 4,479,359 to Pelloix-Gervais 1984 Oct. 30 shows an atmospheric heater for cryogenic fluids of "higher heat exchange efficiency" (col. 1, lines 25-28). Particularly, the air flow passages of the individual heat exchange elements are discussed (col. 1 lines 57-60). The inner fin configuration with the preferred all aluminum heat exchange element in col. 1, lines 35-40 limits the configuration to lower pressure cryogenic fluids. The attempt by Pelloix-Gervais to gain an increase in overall heat gain by painting some external portions black is noteworthy, however, in large regasification systems, the percent of the total heat transfer surface which can be profitably exposed to solar radiation is to the order of 1% thus limiting any solar gain to be well below ¼%. For this reason, naturally oxidized aluminum is the outer surface material preferred, by present art. Pelloix-Gervais does not instruct upon the effect of ice thickness on heat exchanger efficiency or configuration.

It is well-known that in the particular case of heat exchangers wherein boiling and vaporization take place within the tubular passages that tube inserts offer advantage as described in the aforementioned art. Inserts of many configurations are illustrated in prior art. In U.S. Pat. No. 5,341,769 to Ueno et al 1994 Aug. 30 shows seven insert configurations to improve the regasification in seawater LNG vaporizers. The falling (water) film counter current heat exchanger panels described tend to have ice build-up, which Ueno attempts to mitigate with the insulated type insert described. Also described is pressure contact for controlled heat transfer (col. 4, lines 23-25). In U.S. Pat. No. 4,296,539 to Asami 1981 Oct. 27 a particular twisted spoke type insert for the improvement for water spray natural gas evaporators (col. 2 lines 12-21) is shown. Asami further instructs on the film boiling aspect of cryogenic vaporizers (col. 1, lines 37-56) and for the particular case described, the helix configured has a defined twist ratio between 5 and 15. Asami apparently fails to appreciate the relationship between his defined twist ratio and the centrifugal separating force required between the evaporated fluid and the fluid liquid droplets described, especially for the case of LNG, which is not a pure fluid, but rather a mixture of components which do not boil at the same temperature producing lower rates of heat transfer. His defined twist ratio results in reduced separation of fluid phases due to the relatively large internal diameter of the tube, which is in the case described between 10 to 20 cm or between about 4 to 6 inches. Asami also fails to instruct the effect of pressure on the internal heat transfer process. As pressure increases, the contrast in the density of the fluid evaporated portion and fluid liquid portion diminishes by the well-known laws of thermodynamics, requiring an increased centrifugal force to effectively separate the two fluid phases for the purpose of higher heat transfer during vaporization. It is well known to those skilled in the art that lower twist ratios, which as defined results in more twists per foot of length, improve boiling heat transfer over higher twist ratios. In a process described in U.S. Pat. No. 6,664,432 B2 to Ackerman 2003 Dec. 16 an internal insert combined with a reaction catalyst is described as being effective using an insert causing a pressure drop increase of not more than three times that of a bare tube (col. 3, lines 3-8). The inserts described by Ackerman apply to a particular retrofit process (col. 3, lines 59-61) thereby requiring restrictions which do not apply to processes operating at higher pressures, different temperature ranges, for different reasons, or where significant vapor superheats are required.

Although the use of seawater or atmospheric ambient air offers the advantage of not requiring added heat from a source such as fuel combustion, controlling the seawater or atmospheric air is of a particular concern. In U.S. Pat. No. 6,089,022 to Zednik, 2000 Jul. 18, seawater is pumped through a heat exchanger on board a ship to regasify LNG. As instructed by Zednik (col. 5, lines 30-40) the relationship between where the seawater intake is located and where the seawater is discharged back into the sea is defined for efficient operation. Although the positioning described by Zednik for seawater is instructive, the differences between seawater and atmospheric air in a natural convection heat exchanger requires a different solution for ambient air vaporizers.

In heat transfer processes where the heat flow passes through two or more materials in contact with one another, the contact surfaces are a source of inefficiency. Generally, as described above, those skilled in the art attempt to provide intimate contact by deformation, intimate pressure contact and the like. In U.S. Pat. No. 4,487,256 to Lutgens et al 1984 Dec. 11 there is described a cryogenic ambient air heat exchanger employing a pair of externally finned elements clamped onto a smooth inner fluid conduit tube to maintain intimate contact at the mating metal surfaces. Likewise, in U.S. Pat. No. 3,735,465 to Tibbets 1973 May 29 a related clamping system is described. U.S. Pat. No. 4,598,554 to Bastian 1986 Jul. 8 discloses a stainless steel finned element vaporizer system with the fins welded and bonded to the stainless steel horizontal tubes for the particular purpose of structural rigidity (col. 3, lines 41-45). What this prior art apparently fails to realize or does it instruct is that due to the surface imperfections within the metal mating surfaces when these surfaces are brought into intimate contact they contain air pockets or cavities which considerably restricts the free flow of heat between the metal surfaces. It is known that elimination of these cavities between the mating surfaces can reduce the contact resistance to heat flow between the surfaces by 20 times more or less depending upon the process used. Tibbets and Lutgens fail to instruct in this regard nor do they teach that contact pressures above 1000 PSI do not fully eliminate the resistance to heat flow caused by the mating surface area pockets.

Now it is realized by those skilled in the art of heat transfer that the heat from the air must pass from the air to the cryogenic fluid through a series of resistances to the free flow of the heat required. These include: free air flow, air to ice layer, through the ice layer to the metal surface, down the fin length, through the metal hub, through the contact resistance between hub and higher pressure tube surfaces, through the high pressure tube wall, through the fluid to tube wall boundary layer and finally into the temperature gradient within the vaporizing fluid. To improve the total heat transfer process, each of these elements of the heat transfer process needs to be evaluated and improved in order to offer improvement of the overall heat transfer process essential to the regasification process.

Accordingly, there is a need for a natural convection ambient air cryogenic vaporizer regasification process and method, which improves the free flow of atmospheric air, increases the total heat transfer performance and provides a more compact and economical vaporizer heat exchanger, which operates continuously.

OBJECTS

The present invention is directed a system and process for an improved cryogenic natural convection atmospheric air vaporizer system and process. The process comprises:

a) Arranging an array of ambient air vaporizer heat exchangers into a pattern of rows and lanes for the purpose of providing unrestricted and uniform flow of the ambient air heat source through the array, thereby increasing the flow of free air to improve the regassification process.

b) Mounting each of the ambient air counter-flow, parallel connected vaporizer heat exchangers within the array on an extended base for the purpose of permitting the cooled ambient air heat source to discharge beneath and away from the multiple vaporizer array in an unrestricted manner thereby improving the benefit of true counter flow heat exchanger performance.

c) Operating the array of ambient air vaporizer heat exchangers continuously by arranging the array into two or more switching banks for the purpose of the natural defrost of the bank, which is idled, thereby limiting ice thickness and restoring heat exchanger performance.

d) Utilizing all counterflow vertical vaporizer heat exchangers, which provides a low or no ice zone at the warmer top fluid exit exposed to the entering warmer atmospheric air for the purpose of an improved heat transfer process and permitting the use of hybrid heat exchange elements within the vaporizer heat exchangers which have a greater number of external fins exposed to the air at the upper portion than at the bottom of the heat exchange element which may have a greater thickness of ice accumulation, thereby reducing the physical size of the vaporizer heat exchangers.

e) Parallel connecting the ambient air heat exchangers, which have a flow balancing, flow stabilizing venturi shaped injector positioned at the entry to each heat exchanger element within the vaporizer heat exchangers for the purpose of controlling flow maldistribution and flow instabilities at reduced pressure drop.

f) Providing a high pressure, smooth interior surface austenitic stainless steel tube inserted into and bonded to each heat exchange element of the atmospheric vaporizer heat exchanger for the purpose of containing the high cryogenic fluid pressure and improving the flow of heat from the exterior aluminum extrusions to the stainless steel tube by the bonding process and bonding material, which eliminates air pockets at the mating metal contact surfaces.

g) Incorporating critical twist ratio vortex generators within the full length of the stainless steel tubes within the heat exchange elements for the purpose of increasing the cryogenic fluid heat transfer coefficient along the full tube length and providing a critical twist ratio for the two-phase fluid zone of the heat exchanger, said critical twist ratio creating the centrifugal force necessary to separate the warmer, lighter phase of the two-phase boiling fluid and the heavier dispersed droplets of unvaporized fluid, thereby, preventing the dry out condition by maintaining the liquid phase at the interior surface of the S.S. tube for improved heat transfer.

h) Utilizing an improved heat exchanger heat transfer element for incorporation into the vaporizer heat exchangers, which elements are characterized by having a series of parallel external fins permitting external heat exchange surface area with less loss of exposed surface area to the air during a defined operating period due to ice layer buildup than radial external fins of the prior art vertical, parallel connected heat exchanger elements.

SUMMARY

Now it has been discovered that the present invention provides an improved system and method for regasifying LNG and other cryogenic liquids such as nitrogen and oxygen, whereby the above noted problems are eliminated, improved or minimized by an assembly of single pass, vertically oriented, counter current ambient air heat exchangers. Each heat exchanger including a plurality of improved externally finned aluminum heat exchange elements with austenitic stainless steel tube liners thermally and mechanically bonded within the extrusions, said liners fitted with suitable inserts to enhance internal heat transfer. Additionally each heat exchanger of the assembly is mounted on an extended base to provide increased counter-current natural convection air flow, said heat exchangers assembled in several rows and lanes providing free access for the ambient air to freely flow in its naturally downward passage over the individual heat exchange elements and upon cooling, exiting the assembly of heat exchangers through the open area beneath the heat exchangers provided by the extended base. To provide continuous vaporization capacity, the assembly of the heat exchangers is divided into two or more rows or banks of heat exchangers to permit periodic ice or frost removal by interrupting the vaporization process in one of the banks while the alternate bank is operating, i.e. switching the cryogenic flow between banks.

Additional objects, embodiments and details of this invention are set forth in the following drawings and description.

DETAILED DESCRIPTION OF THE INVENTION

Figure 1:
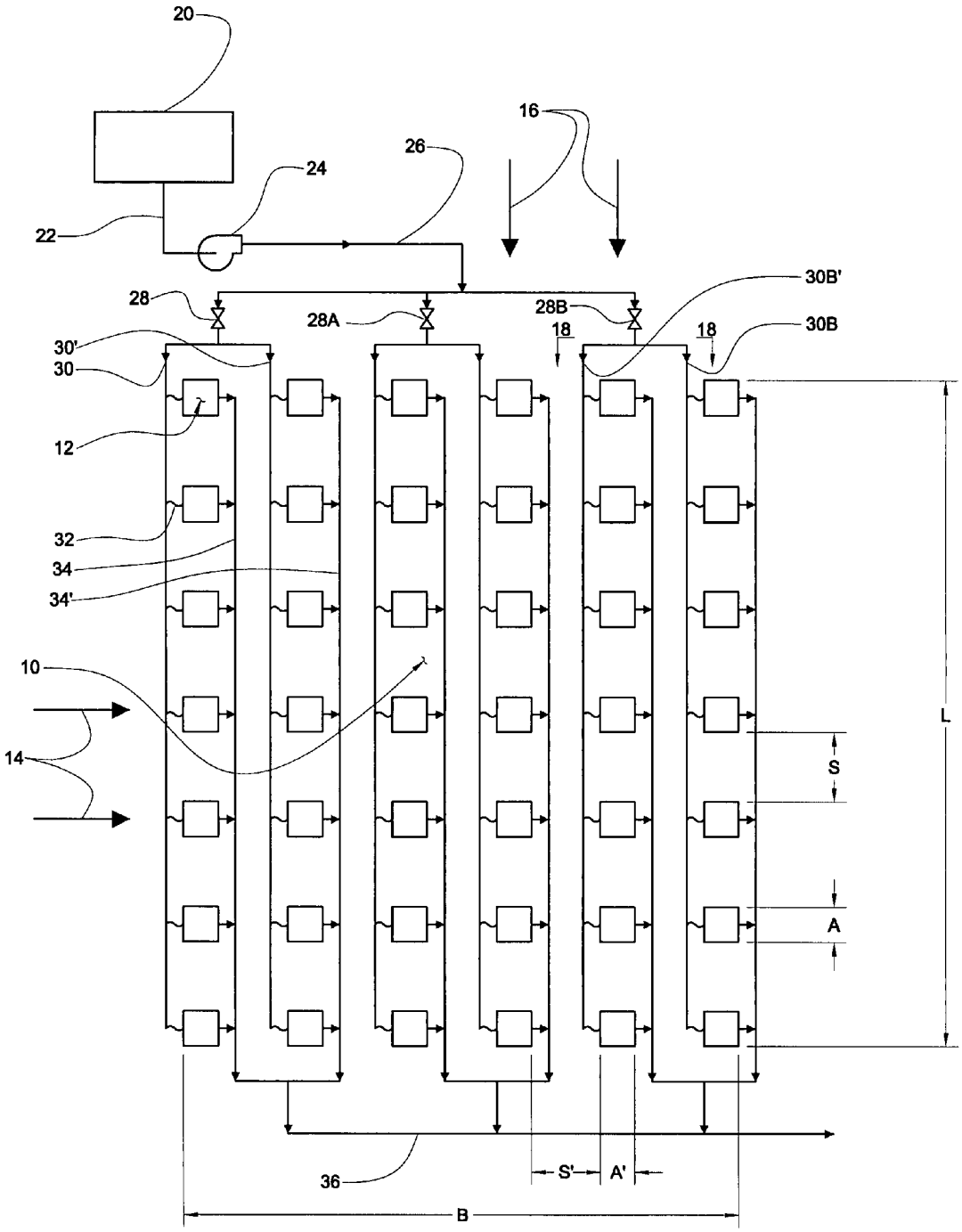
FIG. 1 is a plan view of a regasification system and heat exchanger array in accordance with the present invention.

A simplified drawing of a liquefied natural gas (LNG) or other cryogenic fluid regasification process is shown in FIG. 1. As shown, an array 10 of multiplicity of natural convection ambient air vaporizer heat exchangers 12 with the heat exchangers spatially positioned into a grid or pattern of multiple rows 14 and lanes 16. The array 10 is divided two or more sets or banks 18 of the lanes 16. Cryogenic liquid is stored in tank 20, flows out through liquid line 22 to pump 24, where the pressure is raised to a desired pressure such as supercritical 1100 pounds per square inch (PSI) for LNG, then passing to header 26 then to branch diverting valves 28, 28A, 28B and into the sets 18 of lanes 16 of vaporizers 12 of array 10. The multiplicity of heat exchangers 12 are connected in parallel such that the cryogenic fluid enters all vaporizers 12 of each set 18 in an equally distributed portion to each vaporizer the fluid passing first through inlet conduits 30, 30' and flexible connector 32. The cold liquid is warmed, vaporized and superheated as it passes through vaporizer heat exchangers 12 and exits heat exchanger 12 through gas conduits 34, 34'. passing through master gas header 36 to the point of use.

The array 10 of forty-two vaporizers 12 of FIG. 1 are shown arranged into a spatially defined pattern of six lanes 16 and seven rows 14 and further grouped into three sets 18 with two of the lanes 16 per set 18. Such a disposition of the multiplicity of vaporizers permits the operation of the three sets 18 either as an individual set or any combination of sets by directing the cryogenic fluid through one or more of the three diverting valves 28, 28A, 28B. In one preferred operating mode, two of the sets of the vaporizers are in operation, while one of the sets is off or as sometimes stated as a "2 on-1 off switching cycle". A preferred cycle of the present invention of six hours would then result in each of the three sets being "on" or operating in the vaporizing mode for 4 hours and "idle" or defrost mode for 2 hours. Every 2 hours of the switching cycle, one set 18 which has been idle for 2 hours begins vaporizing via its diverting valve 28 with one of the two "on" sets 18 then switched off for 2 hours of periodic defrost permitting a continuous operating cycle.

Now again referring to FIG. 1, the spatial ratio between vaporizers 12 within the array is defined as the space S between vaporizers divided by the vaporizer width A. Further, the array breadth B is required to be proportioned so as to permit unrestricted free flow of air through the array 10. Array length L is fixed by the number of vaporizer 12 in each lane 16. In a preferred embodiment of forty-two vaporizers 12 of FIG. 1, each vaporizer 12 has a width A of 8.5 feet and a space S of 5.5 feet or a spatial ratio A/S of 8.5/5.5 or 1.55:1. The width of the array B of the preferred embodiment of FIG. 1 has six lanes 16 then becomes 78.5 feet. It will be understood that an array 10 of a greater number of heat exchangers 12 arranged in "2 on-1 off" switching cycle, that array length L increases in accordance with the preferred spatial ratio A/S at 1.55:1 and array width B remains constant as defined by the six lanes 16 of the array for the purpose of maintaining the free and unrestricted flow of air downward through the array it further being understood that as the array width B is increased should additional lanes 16 be added to the preferred array as shown in FIG. 1, resistance to the free flow of air is increased.

Figure 2:
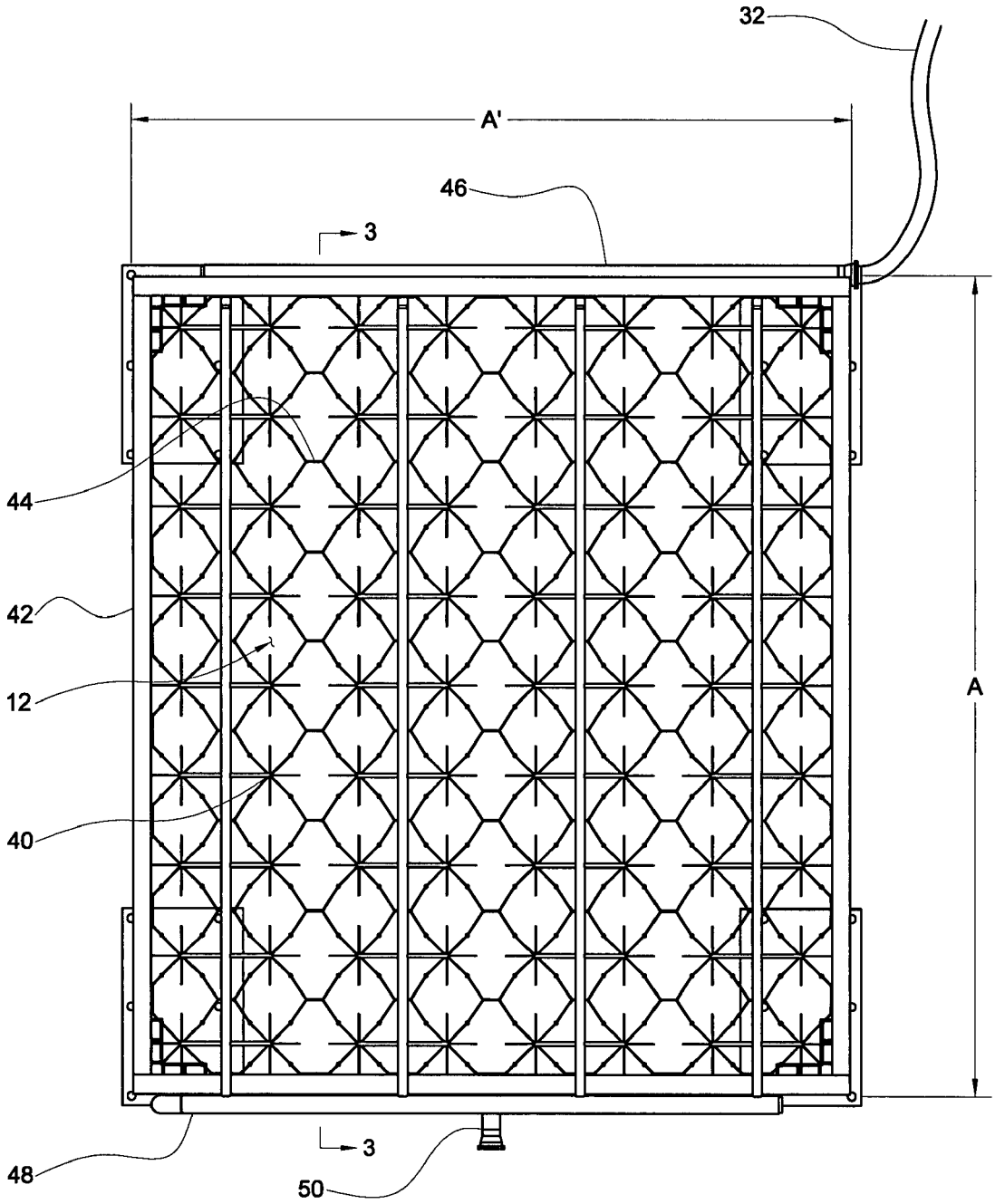
FIG. 2 is a plan view of one of the heat exchangers in the array of FIG. 1.

Now referring to FIG. 2 is shown a plan view of one of the heat exchangers 12 of FIG. 1. A plurality (72 in number) of vertically oriented heat exchanger tubes or elements 40 are mounted within a frame 42 and spatially arranged within the frame having the exchanger width A by support clips 44. Cryogenic fluid enters the heat exchanger through the flexible connector 32 (FIG. 1) to a bottom heat exchanger manifold 46 which distributes the cryogenic fluid proportionally to the bottom of each of the elements 40. The so distributed liquid passes upward through elements 40 passing into and through a top heat exchanger manifold 48 to heat exchanger outlet 50, said outlet being connected to the exit gas conduit 34 in FIG. 1. It will be understood that any number of elements 40 may be connected in the manner described using support clips 44, which would define a different frame width A or A.

Figure 3:
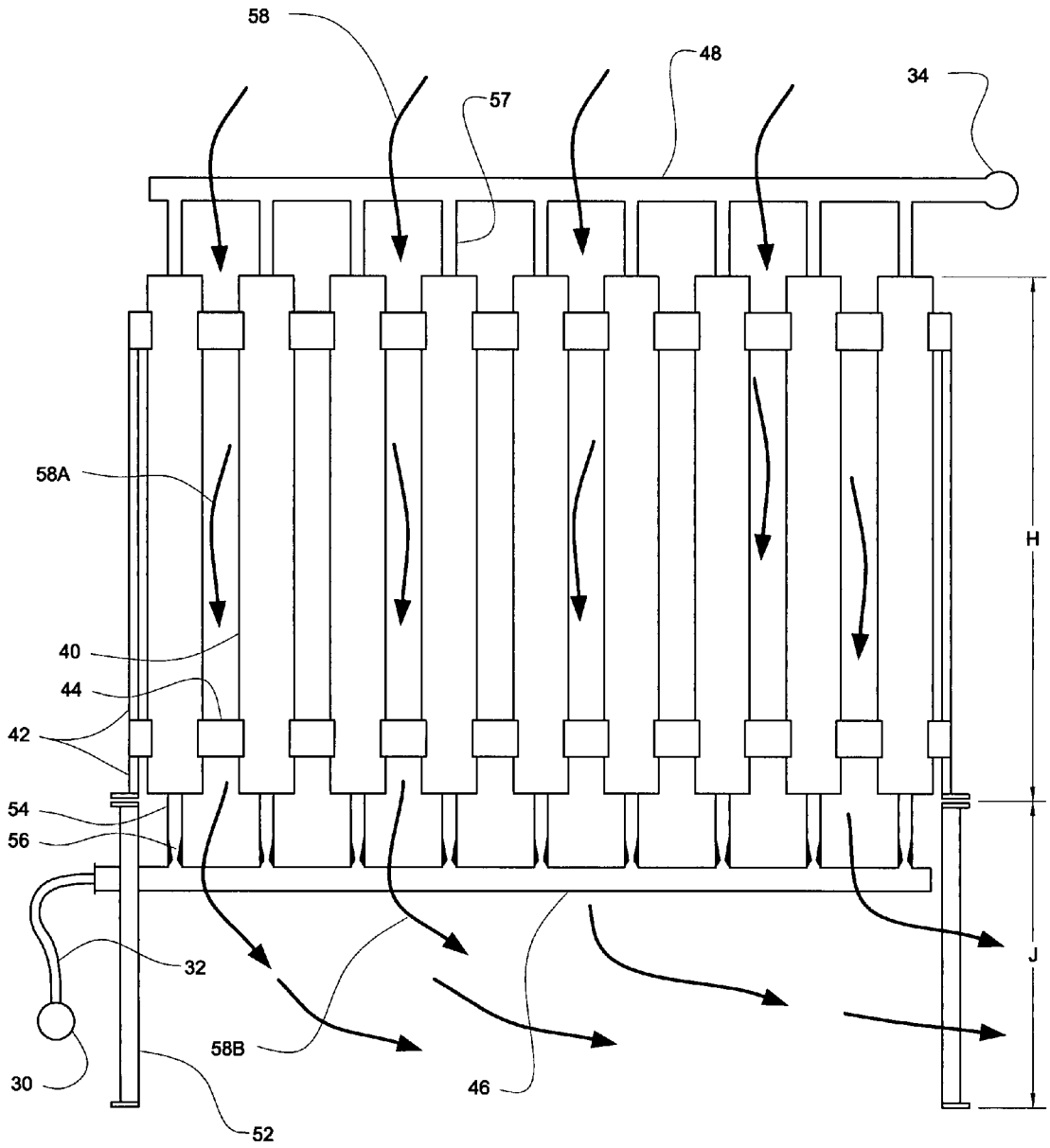
FIG. 3 is a side elevation view taken along lines 3-3 of a natural draft atmospheric vaporizer heat exchanger of FIG. 2 in accordance with the present invention.

Now referring to FIG. 3 is shown a side elevation view taken along lines 3-3 FIG. 2 of a natural draft atmospheric vaporizer in accordance with the present invention. Here heat exchange elements 40 of a height H are spatially positioned with the clips 44 within the frame 42 (FIG. 2). Said frame is mounted onto an extended base 52 which has a height J. Cryogenic liquid enters the heat exchanger from the inlet conduit 30 flowing through the connector 32 to the bottom exchanger manifold 46 shown in FIG. 2. The liquefied gas passes proportionally into each of the vertical, parallel connected elements 40 at element entry nozzle 54, which contains a venturi shaped flow distributive means 56. Said venturi shaped means incorporates by reference my co-pending Utility application Ser. No. 11/431,999/May 11, 2006. the disclosure of which is herein included by specific reference. The proportionally distributed liquefied gas passes vertically upward within element 40 where it is vaporized and warmed to element outlet nozzle 55 and leaves the exchanger 12, FIGS. 1 and 2, after passing through the top manifolded 48 to exit gas conduit 34, FIG. 1 Now it is understood that as the cryogenic fluid, which is colder than the surrounding air 58, rises within exchanger element 40 said cold fluid causes the natural air to cool, thereby transferring a portion of its heat to the rising cryogenic fluid. The cooling air thereby becomes heavier by the rules of thermodynamics. The cooler, heavier air 58A FIG. 3 flows downward by the natural convection thus established and at its coldest condition 58B exits the heat exchanger freely through the open space 59 within extended base 52. In accordance with the present invention, it has been discovered that the free and natural downward convection of the air 58, 58A and 58B is improved when the extended base ratio of the exchanger element height H FIG. 3 divided by the extended base elevation J, FIG. 3 is between 2.5 and 4. In a preferred embodiment this invention the element height H FIG. 3 of 40 ft. divided by the elevated base height J of 13 ft., the extended base ratio H/J is about 3.1.

Figure 4:
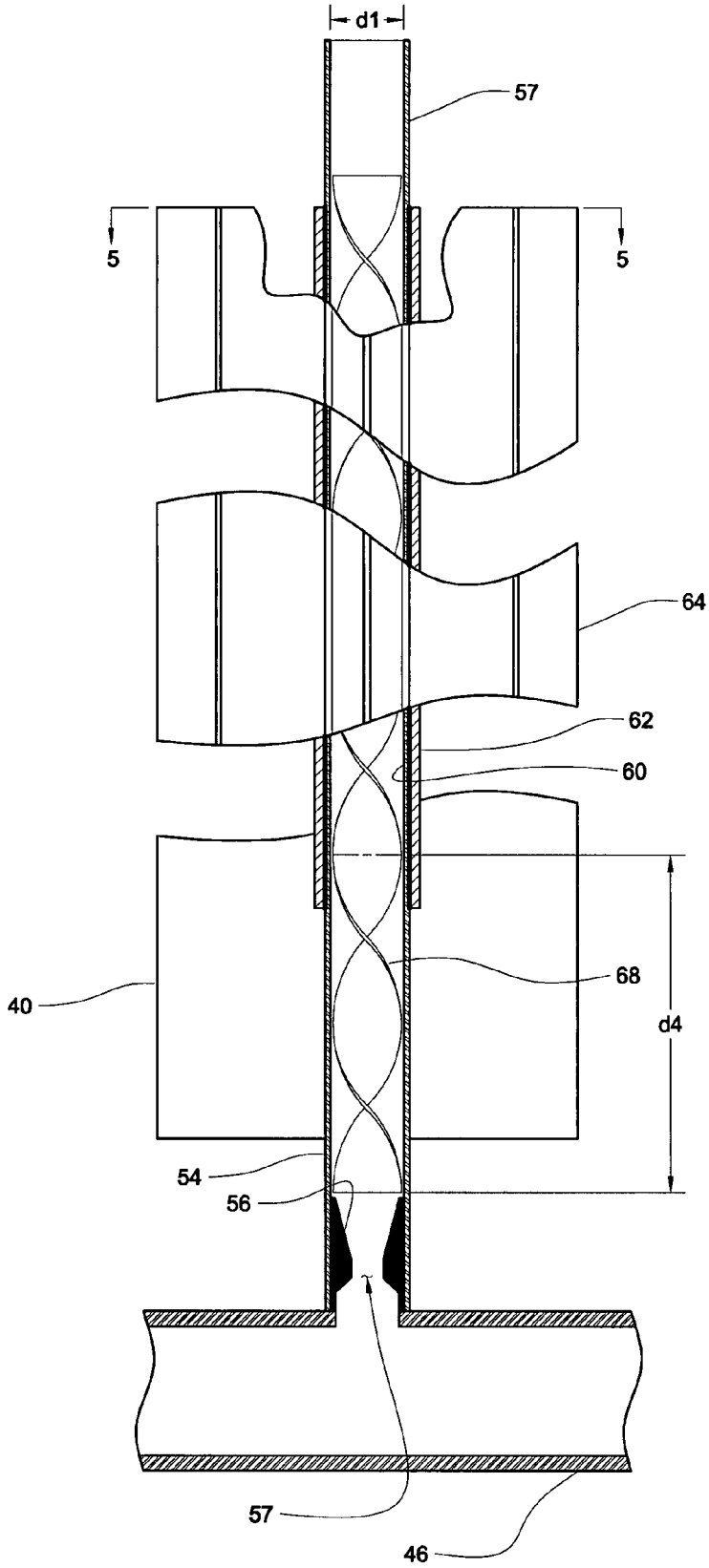
FIG. 4 is a side elevational view partially broken away of one of the heat exchange elements of the vertical heat exchangers in FIG. 2.
Figure 5:
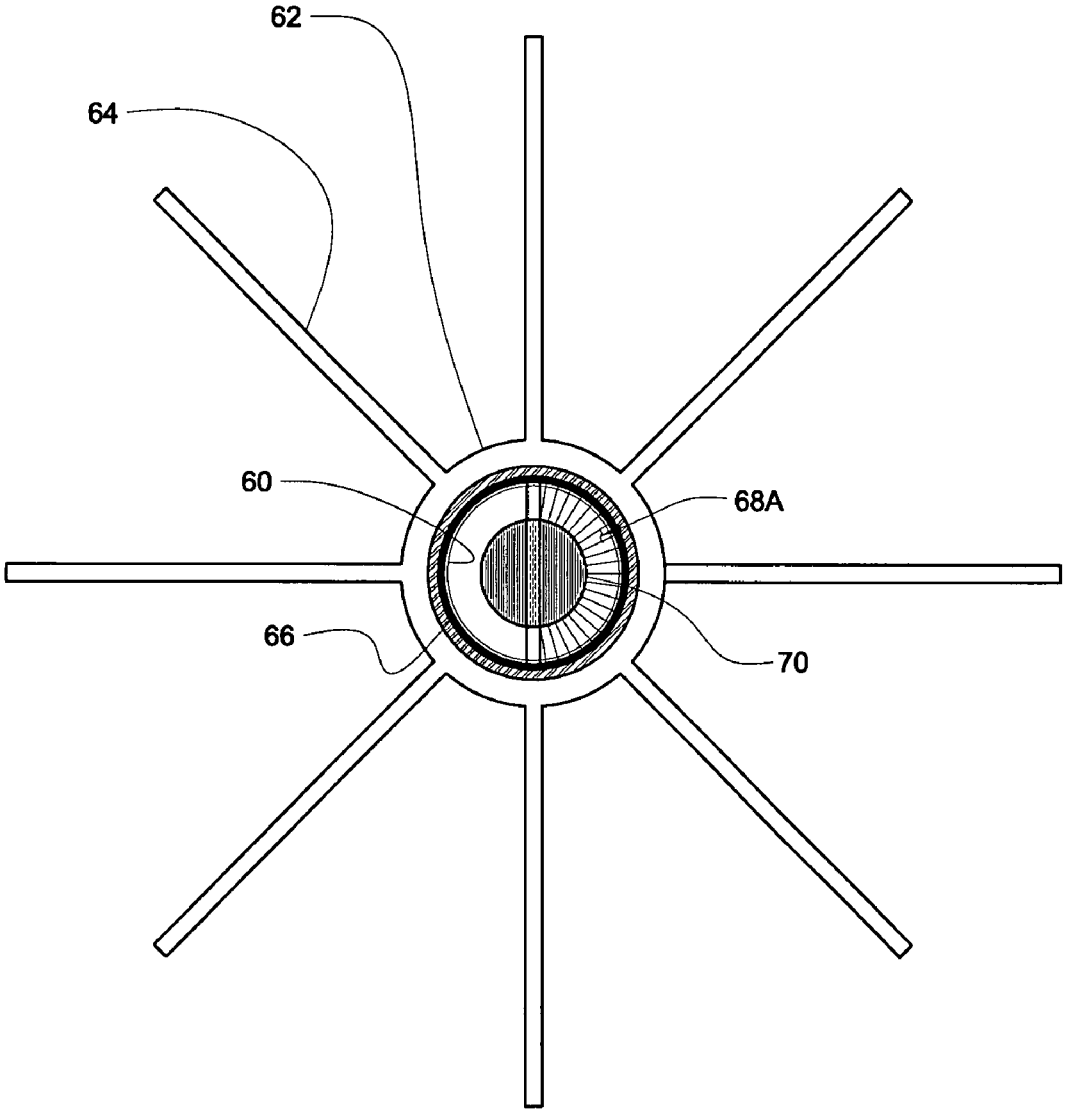
FIG. 5 is a cross-sectional view of the heat exchange element taken along lines 5-5 of FIG. 4.

FIG. 4 is a side elevational view partially broken away of a typical heat exchange element 40 FIG. 2 and FIG. 5 is a plan view of the element taken along lines 5-5 of FIG. 4. The particular element 40 FIG. 4 comprises a central austenitic stainless steel tube 60 contained within a central hub 62 with fins 64 said hub with fins are of extruded aluminum. The center tube 60 of austenitic stainless steel has an outside diameter of from 0.375 inch to 1.0 inch preferably about 0.5 inch and is of sufficient thickness to contain the fluid at the requisite supply pressure. The tube 60 is bonded to the interior surface of hub 62 by firstly applying a coating of thermally conductive adhesive 66 to the exterior of tube 60 before inserting the tube into hub 62. After full insertion, the tube 60 is expanded by such well-known means as hydraulic pressure such expansion causing hub 62 to likewise expand proportionally. The combined expansion causes the stainless steel tube to permanently deform while the more flexible aluminum hub continues to exert an external force against the tube 60 after the hydraulic pressure is released thereby forcing the coating of thermally conductive adhesive to expel air from between the two metallic surfaces for the purpose of reducing the contact resistance to the free flow of heat from fins 64 through hub 62 to tube 60.

Figure 8B:
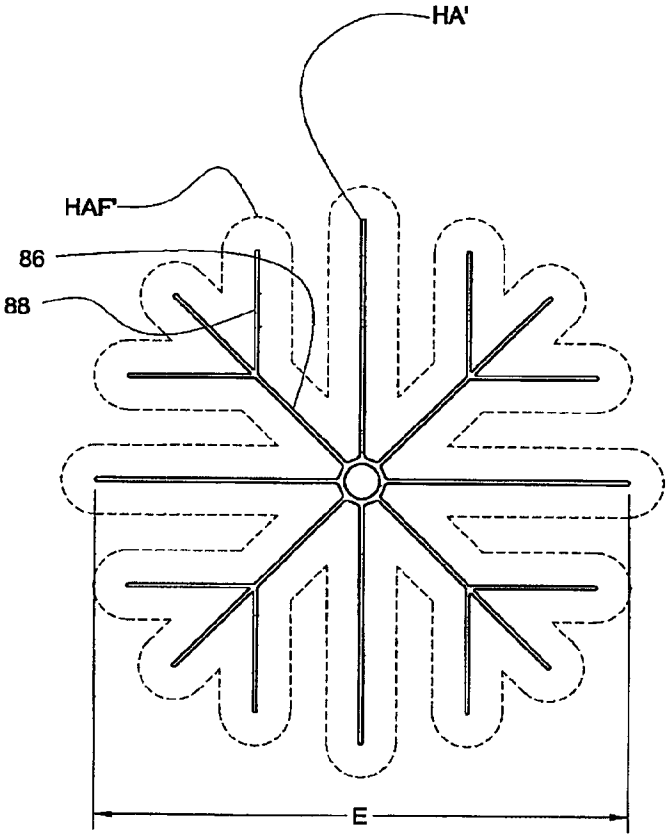
FIG. 8B is a cross-sectional view of an 8 radial-8 parallel fin heat exchange element of FIG. 4.
Figure 8A:
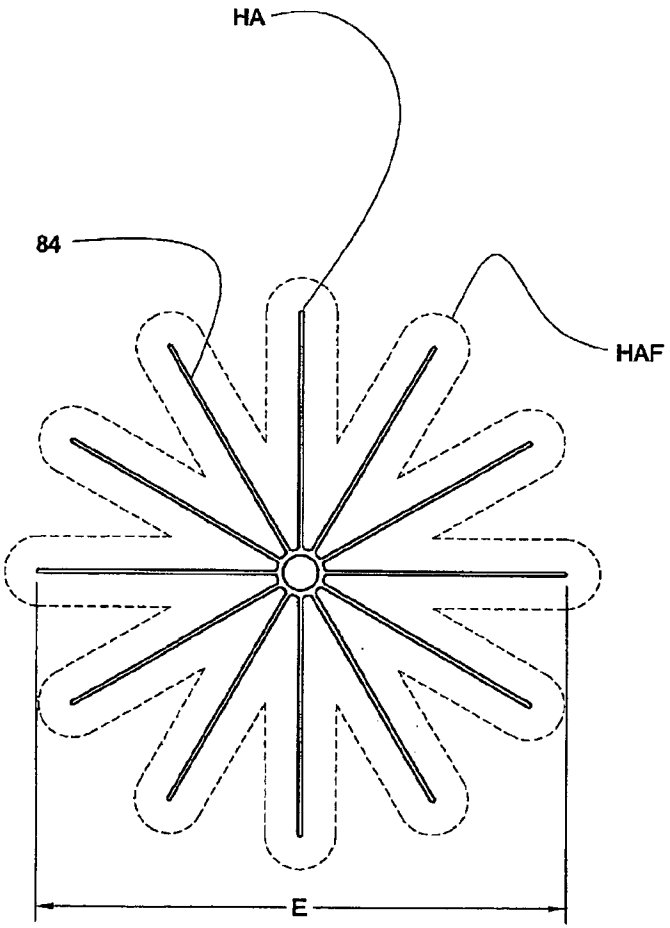
FIG. 8A Is a cross-sectional view of a 12 radial fin heat exchange element of FIG. 4.

Within the element entry nozzle 54 FIG. 4 is positioned a venturi shaped flow restrictor 56. The venturi has a minimum internal diameter or throat 57 of between ⅕ to ½ of the tube internal diameter d1 FIG. 4 preferably about 0.15 inch for a tube 60 having an internal diameter of 0.4 inch. The stainless steel tube 60 has a vortex generating tube insert 68 extending substantially the full length of the element 40. Tube insert 68 is in the form of a twisted strip or tape, preferably of brass, aluminum or austenitic stainless steel sized to fit easily within tube 60. In a preferred embodiment, insert 68 in the twisted form has a twist ratio as defined by the length $d_4$ shown on FIG. 4 divided by the tube 60 internal diameter $d_1$, FIG. 4 of between 2 and 4 preferably about 3. In a second embodiment of the insert 68 shown in FIG. 5 as 68A, the metal strip is provided with a central solid circular portion 70, which occupies a defined portion of the internal flow area of tube 60 for the purpose of increasing the velocity and heat transfer coefficient of the cryogenic fluid and reducing cost of manufacture. The diameter of the central portion 70 is between ⅓ and ¾ of tube diameter $d_1$, preferably about ½. The fins 64 (FIGS. 4 and 5) extend from hub 62 in radial fashion and extend axially or longitudinally along the hub 62 for substantially the entire length of the element. The fins normally have a radial length from 3 to 4 times the outer diameter of the hub, preferably about 3.5 times the diameter of the hub. In a preferred embodiment, the hub outer diameter is ¾ inch. The fins are 3⅝ inch resulting in an 8 inch fin tip to fin tip dimension E (FIG. 8A). The fin thickness in the preferred embodiment is between 0.055 and 0.07 inch thick, which thickness is adequate to provide adequate mechanical strength and heat conduction path from the fin tip to the central hub 62. The number of fins can range from 4 to 20 fins on a single hub. In one preferred embodiment with the 6 hour operating cycle above described, the preferred number of fins is between 12 and 20 with the heat exchange elements being spatially positioned with clips 44, FIGS. 2, 3 at a distance between fin tips of 1.5 to 5 inches preferably about 4 inches.

Accordingly, to the present invention it is not always necessary that the number of fins, 64 FIG. 4, extend substantially the entire length of the tube 60. When the number of fins varies on elements comprising an ambient air vaporizer heat exchanger it is here defined as a hybrid vaporizer heat exchanger.

Figure 6:
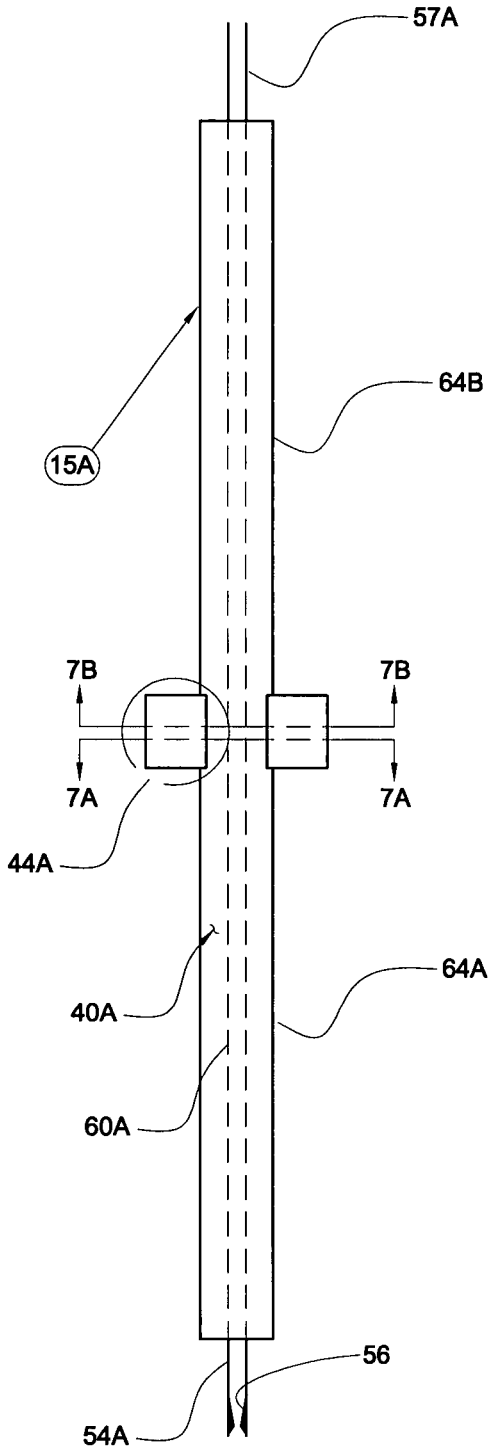
FIG. 6 is a side-elevational view of the heat exchange elements in alternate hybrid form.
Figure 7:
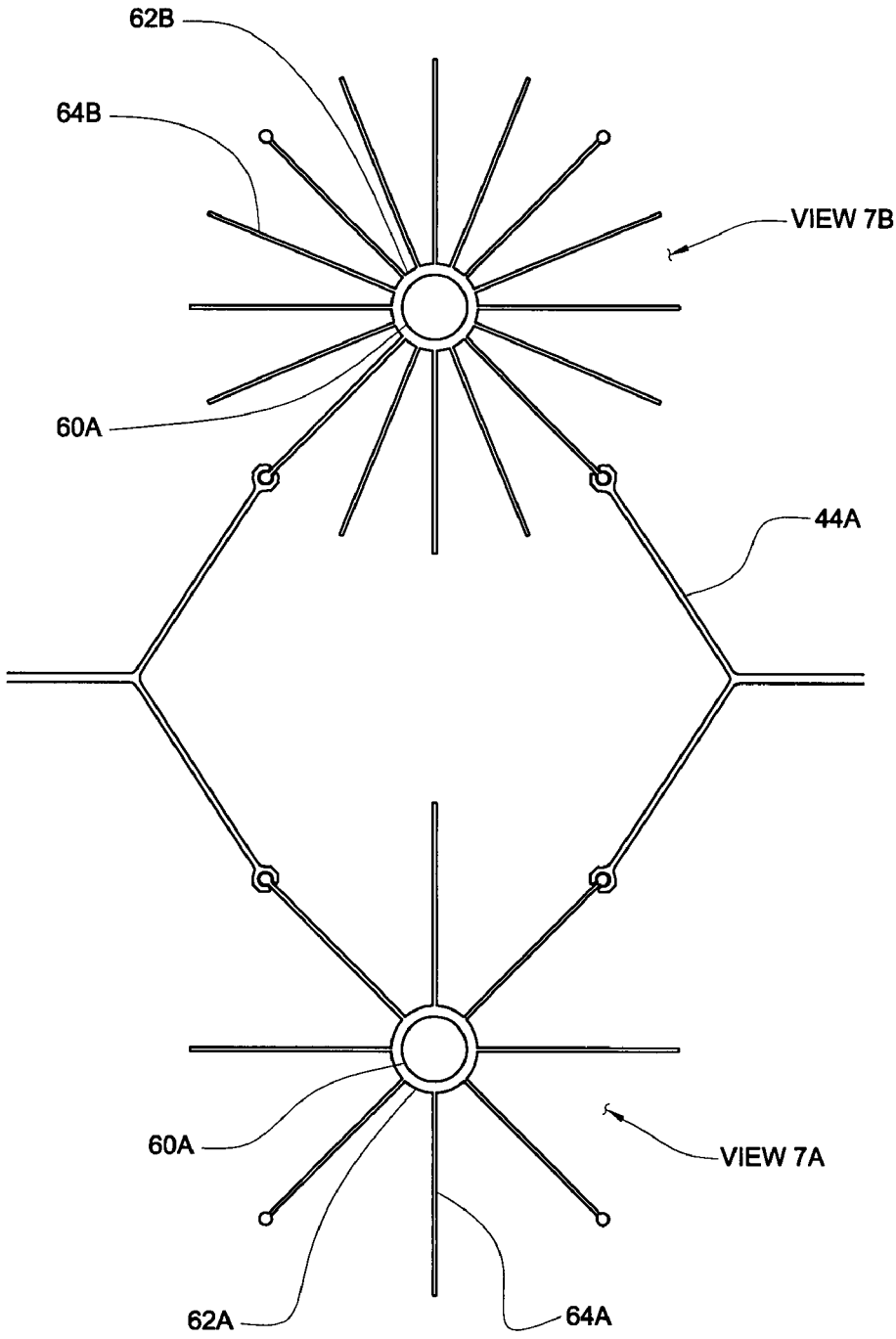
FIG. 7 is a simplified cross-sectional drawing illustrating the connective means and hybrid form of a stainless steel tube lined heat exchange element of FIG. 6.

In another embodiment of the present invention will be described with reference to FIGS. 6 and 7. The embodiment is characterized by varying the number of fins along the vertical parallel heat exchange element of this invention having a lesser number of fins on the bottom inlet portion view 7A FIG. 7 where ice growth is more rapid and a greater number of fins on the upper or outlet portion view 7B FIG. 7 of the element where ice growth is less or not present. Such a single vertical element is now defined as a hybrid element. Now referring to FIG. 6 hybrid element 40A is comprised of interior tube 60A entry nozzle 54A with venturi 56 inserted within said entry and exit nozzle 55A. Assembled onto the lower portion of tube 60A is extruded aluminum hub 62A FIG. 7 containing a number of fins 64A. In the embodiment of this invention, the number of fins on this lower hub 62A is between 4 and 16, preferably between 8 and 12 as shown schematically on the lower portion of FIG. 7 taken along lines 7A-7A on FIG. 6 as view 7A. On the upper portion of tube 60A FIG. 6 is hub 62B FIG. 7 containing a number of fins 64B. In the embodiment of this invention the number of fins on this upper hub 62B is between 8 and 20 preferably between 12 and 16 as shown schematically on the upper portion of FIG. 7 taken along lines 7B-7B on FIG. 6 as view 7B. The finned hub portions 62A and 62B are rigidly connected and spatially positioned within the heat exchanger with clips 44A which for the hybrid element 40A clips 44A serve a dual function. In the preferred embodiment of this invention, hybrid element 40A has vortex generator 68 FIG. 4 inserted within said tube 60A which is bonded into hubs 62A and 62B simultaneously in the manner above described. The hybrid element 40A thus shown provides the advantages of improved heat transfer both internally and externally, reduces the number of fluid pressure connections and is easily manufactured.

In yet another embodiment of this invention, the external fin geometry is characterized by varying the orientation of any number of the external fins extending from the central hub to be parallel to each other rather than radial from the hub as shown 64 FIG. 5. Radial fins have the advantage of ease of manufacture by such well known means of aluminum extrusion. For atmospheric air cryogenic vaporizer heat exchangers, the disadvantage of radial fins is due to the reduction of the surface area exposed to the atmospheric air heat source as the ice layer thickness increases during the operating period of the heat exchanger. White, as reviewed above, instructs that as ice build-up increases with time (col. 1 lines 49-60) the surface area of the vaporizer is reduced with a resulting loss of efficiency. White also instructs that the ice layer thickness is related to the period of operation (White, other publications, Thermax Product Datasheet 3.1 and Thermax Product Datasheet 3.6. Now referring to FIGS. 8A and 8B are shown a conventional twelve radial fin element as FIG. 8A and a parallel finned element of this invention as FIG. 8B having in combination eight radial and eight parallel fins. Said FIG. 8B with a combination radial and parallel fins incorporates by reference my co-pending Utility application Ser. No. 11/584,040/Oct. 24, 2006 the disclosure of which is herewith included by specific reference. The external finned surface area HA and HA' exposed to the air in the no ice condition of both the conventional element 8A (12 radial fins 84, FIG. 8A) and element 8B (8 radial fins 86, FIG. 8B plus 8 parallel fins 8B, FIG. 8B) is about the same. In a preferred embodiment of this invention the tip to tip dimension E, FIGS. 8A and 8B is 8 inches and the element surface area HA, HA' for both elements is about 90 inches of perimeter. Now when the non-iced surface area exposed to the ambient air and in operation until ½ inch ice forms on the surface HA and the iced surface of the elements HAF FIG. 8A and HAF' FIG. 8B is measured with said ½ inch of ice formation corresponding to an operation period of about 5 hours as instructed above and in prior art, the frosted exposed surface area HAF FIG. 8A is about 68 inches and the exposed surface area HAF' FIG. 8B for the same ½ inch ice layer is about 77 inches. The relative benefit in heat exposed heat transfer area for this condition for FIG. 8B over FIG. 8A is about 13% resulting in a more efficient heat transfer process for the defined operating cycle. The combined radial-parallel finned heat exchange element is not limited to the number of fins as above numbered primary radial and parallel secondary fins, but more importantly by the operating cycle and the related thickness of ice collected during operation of said cryogenic ambient air heat exchangers.

The regasification system and method of this invention may also be provided with one or more control devices. One such device is to control the flow rate of the fluid to the different sets of heat exchangers within the array or to each heat exchanger within the sets. By regulating the flow of fluid one can compensate for changes in the ambient air temperature and/or system heat transfer for efficiency within the array. A second such device is a timing device which automatically controls the switching time cycle of the flow diverting valves 28 of the sets 18 of heat exchangers 12, FIG. 1.

This invention by employing singly or in combination the spatial ratio between heat exchangers, the switching cycle between heat exchangers, the switching cycle between sets of heat exchangers, the ratio of element height to extended base height, the heat exchanger heat transfer system of hybrid finned elements, the thermally bonded stainless steel liners, critical twist ratio vortex generators and venturi shaped flow distributors provides an atmospheric vaporizer system and method capable of vaporizing LNG and other cryogenic liquids on a continuous basis at an efficiency that is considerably higher and within a volume of space that is considerably lower than is achievable by the use of vertical all parallel vaporizer arrays of the prior art.

PRIOR ART

1. U.S. Pat. No. 5,251,452 Wieder/Cryoquip Oct. 12, 1992
   Describes a vertical, all parallel/single pass ambient air vaporizer with external finned elements with internally finned passageways, which are fitted with solid rods full or partial length to increase the heat transfer rate from the air over that of an unblocked tube. Note that the range of outer surface area to inner surface area is between 5/1 and 25/1 with the blocking rod diameter approximately equal to tube inner diameter meter. The blocking rod increases internal heat transfer rate by about two times. The vertical unit with blocking rod increases overall performance by up to 10% over standard up-down units. Noted is much less ice at top of element.

2. U.S. Pat. No. 5,473,905 Billman/Cryoquip Dec. 12, 1995
   Describes an improved heat transfer element for vertical ambient vaporizers/all parallel employing a hollow rod in the bottom and a solid rod in the top to control surge and maldistribution. The vertical elements are of the external/internal finned type as described in prior art ①, U.S. Pat. No. 5,251,452. Orifice controls of prior art and twisted-tape turbulator inserts are mentioned for use on high pressure drop/high pressure vaporizers. The limits of orifice restrictors due to high pressure drop is discussed.
3. U.S. Pat. No. 4,399,660 Vogler Aug. 23, 1983
   Describes a greatly improved vaporizer characterized by a critical pass spacing ratio between 1 and 5. Continuous operation over 6 days is claimed where the critical ratio is defined as fin tip gap/fin length gap. Test data on 4 and 8 fin geometries with gap ratios between 0.4 and 2.9 is given.
4. U.S. Pat. No. 4,479,359 Pellanx-Gervais, Oct. 30, 1984
   Describes a higher efficiency heat exchanger for cryogenic fluids, such efficiency gain being achieved by a defined inner fin geometry L inner fin divided by tube diameter=D of between 0.6 and 1 together with 2 outer branch fins, which are substantially parallel to the radial fins at a distance "d". Low adhesion plastic/PTFE is used on some external fins to avert the adhesion of rime/frost on the external fins. Fans are mentioned to aid the performance of the last passes of the unit.
5. U.S. Pat. No. 4,566,284 Werley, Jan. 28, 1986
   Describes a process and apparatus for an improved vaporizer by means of arranging the vertical star fin elements such that the first-coldest temperature finned pipe lengths are placed at more remote locations from the warmer, exit, such improvement being the result of reduced ice bridging between colder and warmer fins. A specific 12 element circuit is claimed as a process and apparatus.
6. U.S. Pat. No. 5,390,500 White et al Feb. 21, 1995
   Describes a vaporizer process and device comprised of essentially two components to control the ice growth on the external fins of the colder element and superheating the cryogenic fluid in the second warmer module. Ice growth and fog production are reduced. Prior art discussed includes switching one or more banks on various time cycles, when ice growth becomes excessive thereby reducing vaporizer effectiveness. Other prior art means of defrosting such as hot water or manual removal are mentioned.
7. U.S. Pat. No. 4,487,256 Lutgens et al Dec. 11, 1984
   Discusses a means of attaching finned element halves onto a central tubular conduit for a cryogenic atmospheric vaporizer. Said attaching means provides a clamping force, which is maintained during cryogenic contraction of the central tube during operation by providing flexible locking fins, which flex, but do not permanently deform. Good heat transfer contact is thusly provided.
8. U.S. Pat. No. 3,735,465 Tibbets et al May 29, 1973
   A rolling means to provide essentially similar vaporizing elements as in ⑦ U.S. Pat. No. 4,487,256, with the tubular portion of S.S. and the finned portion extruded aluminum. No welding is required for element manufacture.
9. U.S. Pat. No. 4,598,554, Bastian, Jul. 8, 1986
   Describes a stainless steel finned ambient air vaporizer element, in which the external fins are bonded to the tubular conduit by means of welding or ceramic glue.
10. U.S. Pat. No. 6,644,041 B1, Eyermann, Nov. 11, 2003
    Descries an LNG vaporization process whereby heat is obtained from air at 73° F. or higher in a "novel" reverse process cooling tower, which heats the recirculating water, which then heats a secondary heat transfer medium, such as anti-freeze solution, which is pumped to an LNG vaporizer.
11. U.S. Pat. No. 5,400,598 Yamani, et al, Mar. 28, 1995
    Describes a means of using turbine intake ambient air to provide the heat of vaporization for an LNG vaporizer while simultaneously pre-cooling the turbine intake air for increased turbine efficiency. A means of intermittently storing the refrigeration available from the vaporizing LNG as the latent heat of ice is described.
12. U.S. Pat. No. 4,083,707, Bivins, Jr. Apr. 11, 1978
    Describes a cryogenic liquid injector means, including thermal shielding at the vertical heat exchanger tube entrance for the purpose of evenly distributing the cryogenic fluid to each tube, while controlling vapor choking at the entrance of the injector tube.
13. U.S. Pat. No. 6,664,432 B2, Ackerman et. al., Dec. 16, 2003
    Describes an improved acid-alkalization process, where the hydrocarbon is flashed within a bare tube reactor, such improvement being obtained by adding inserts within the tubes to increase heat transfer and increase pressure drop within the tubes. A particularly useful insert is in the form of a twisted strip or tape. The increase in pressure drop preferred by use of the insert is between 1.5 to 2 times, but not more than 3 times.
14. U.S. Pat. No. 1,672,617, Lasker, Jun. 5, 1928
    Describes a twisted metal tape for use in boiler tubes.
15. U.S. Pat. No. 5,341,769, Ueno, et al, Aug. 30, 1994
    Describes a vertical LNG seawater falling film vaporizer. Included are descriptive tube inserts, twisted inserts, insulation means to reduce ice formation at the bottom and header vapor control via double headers with vapor barrier and tube injection means for maldistribution control and reduced header warpage.
16. U.S. Pat. No. 4,296,539, Asami, Oct. 27, 1981
    Describes a vertical falling seawater LNG vaporizer with attention paid to internal heat transfer, tube insets, water/ice problems, fin/fin enhancement, twisted tape with specific L/D twist ratio of between 5 and 15 being most advantageous. Tubes are 4-8 inch dice. Film boiling and mist flow are included (similar to dryout).
17. U.S. Pat. No. 6,089,022, Zednik, et al., Jul. 18, 2000
    Describes a shipboard LNG regasfication system using seawater as the heating means via an intermediate fluid, such as propane. The naturally occurring seawater is pumped through the vaporizer. Said pump water intake and point of discharge back into the sea are separated sufficiently (18 m) to prevent recycling of the seawater.
18. Other Publications
    A. The limiting volume required for cryogenic ambient air vaporizers due to frost formation. AICh E Spring Meeting, May 2000 Atlanta, Paper 58E, PP 188-196 Robert E. Bernert, Sr.

Describes heat transfer and frost effects on ambient vaporizers.

B. Thermax Product Datasheet 3.1 (2-99) and 3.6 (5-99) shows performance decline due to ice build up during the period of operation.

DRAWING REFERENCE NUMERALS WORKSHEET

| NO. | NAME |
|---|---|
| 10 | array |
| 12 | heat exchanger, vaporizer |
| 14 | row |
| 16 | lane |
| 18 | set, bank |
| 20 | tank |
| 22 | liquid line |
| 24 | pump |
| 26 | header |
| 28, 28A, 28B | branch diverting valve |
| 30, 30' | inlet conduit |
| 32 | flexible connector |
| 34, 34' | exit gas conduit |
| 36 | master gas header |
| 40 | heat exchange element |
| 40A | hybrid element |
| 42 | frame |
| 44 | support clip |
| 44A | hybrid clip |
| 46 | bottom exchanger manifold |
| 48 | top exchanger manifold |
| 50 | heat exchanger outlet |
| 52 | extended base |
| 54, 54A | element entry nozzle |
| 55, 55A | element outlet nozzle |
| 56 | venturi flow distributor, restrictor |
| 57 | venturi throat |
| 58 | surrounding air |
| 58A | cooling air |
| 58B | cooled air |
| 59 | open space |
| 60, 60A | stainless steel tube |
| 62, 62A, 62B | central hub |
| 64, 64A, 64B | fin |
| 66 | adhesive, bonding material |
| 68, 68A | vortex generator, insert |
| 70 | solid central portion |
| 84 | conventional radial fin, FIG. 8A |
| 86 | radial fin, FIG. 8B |
| 88 | parallel fin, FIG. 8B |
| A, A' | exchanger width |
| NS | spatial ratio |
| B | array breadth |
| $d_1$ | tube internal diameter |
| $d_4$ | twist length |
| $d_4/d_1$ | twist ratio |
| E | element fin tip to tip dimension |
| H | element height |
| HA, HA' | external finned surface area |
| HAF, HAF' | frosted exposed surface area |
| H/J | extended base ratio |
| J | extended base height |
| L | array length |
| S, S' | exchanger spacing |

What is claimed is:

1. A process for the continuous vaporization of cryogenic fluids and liquefied natural gas (LNG) using heat from the ambient air atmosphere, said process comprising the steps of:

(a) arranging an array of ambient air vaporizer heat exchangers each of said exchangers having a plurality of vertically oriented parallel connected tubular heat exchange elements, wherein said arrangement of said heat exchangers are in vertical parallel relationship to each other into a spatial pattern of rows and lanes that are generally disposed at right angles to each other so as to provide uniform flow of the ambient air through such array from the top to the bottom thereof;

(b) mounting each of the vaporizer heat exchangers on an extended base so as to provide spacing between the bottoms of the heat exchangers and the surface on which said array is supported so as to provide unrestricted flow to the ambient air downward through all of said heat exchangers of said array and discharging said atmospheric air from beneath the heat exchanger array; wherein said spatial pattern is such that the spatial ratio of the heat exchanger's width divided by the space between heat exchangers is between 1 and 2 and wherein said extended base is such that the height of the heat exchanger element divided by the height of the unobstructed distance for air discharge below said heat exchanger bottom is between 2.5 and 4, whereby said extended base is the sum of said unobstructed distance plus any obstruction to air flow on said surface in which said array is supported;

(c) flowing and evenly distributing the cryogenic fluid to each of the all-parallel connected, vertical heat exchange elements of the heat exchangers within said array upward in counter-current flow to the downward natural convection flow of the ambient air;

(d) dividing the array of heat exchangers into two or more banks and providing each of said banks with a flow switching valve utilizing said valve to divert the cryogenic fluid between said banks of heat exchangers thus permitting the natural defrost of one bank while the other bank or banks continue the vaporization process in order to achieve true continuous operation;

(e) providing the individual heat exchanger elements of said heat exchangers with a continuous internal liner tube and inserting a vortex flow generator within the full length of said liner tube and installing a venturi-shaped flow restrictor into the entry portion of each of said heat exchange elements, all of said venturi-shaped flow restrictors being of the same physical size, shape and dimensions;

(f) using a twisted metal tape vortex generator provided with a twist ratio for the 360° twist length divided by the tube internal diameter of between 2 and 3; and (g) wherein said venturi-shaped flow restrictor has a straight sided entry cone and a straight sided exit cone and is provided with a minimum internal throat diameter of between ⅕ and ½ of said tube internal diameter.

2. The process as in claim 1 wherein the height of said vertical heat exchange element is between 30 and 50 feet.

3. The process as in claim 1, wherein said array is divided into three banks.

4. The process as in claim 3 wherein the diverting of the cryogenic fluid between said banks is carried out by controlling said switching valves such that two of said three banks have fluid flowing through them while one of said banks has no fluid flowing through it causing natural defrost.

5. The process of claim 1 including providing the individual heat exchange elements of said heat exchangers with a number of external axial fins and providing each of the individual heat exchange elements with a continuous internal austenitic stainless steel liner tube and expanding and bonding said liner tube within said individual heat exchanger element.

6. The process of claim 1, wherein said heat exchange elements include between eight and sixteen radial fins.

7. The process as in claim 1, wherein said heat exchange elements include a plurality of axial fins with a different lesser number of fins at the bottom inlet portion of said element and a greater number of fins on the upper outlet portion of said heat exchange element.

8. The process as in claim 5 including using hydraulic expansion means of sufficient pressure to cause a hub of said heat exchanger element to deform and continue to exert an external force on said internal austenitic stainless steel liner tube after said hydraulic expansion means hydraulic pressure is released.

* * * * *